US006073978A

United States Patent [19]

Sherman

[11] Patent Number: 6,073,978

[45] Date of Patent: Jun. 13, 2000

[54] DISHWASHER LOCK

[76] Inventor: Ronald Sherman, 19330 Frenchton Pl., Gaithersburg, Md. 20879

[21] Appl. No.: 09/281,063

[22] Filed: Mar. 10, 1999

[51] Int. Cl.[7] ..... E05C 19/06

[52] U.S. Cl. ..... 292/80; 292/87; 292/107; 292/152; 292/DIG. 65; 292/DIG. 69

[58] Field of Search ..... 292/80, 81, 87, 292/99, 101, 107, 145, 146, 152, DIG. 16, DIG. 38, DIG. 69, DIG. 63, DIG. 65, DIG. 71

[56] References Cited

U.S. PATENT DOCUMENTS

| | | | |
|---|---|---|---|
| 529,945 | 11/1894 | Orb | 292/80 |
| 3,069,217 | 12/1962 | Kors | 292/145 |
| 3,797,871 | 3/1974 | Morishita | 292/209 |
| 3,909,050 | 9/1975 | Vicendese et al. | 292/128 |
| 4,379,576 | 4/1983 | Blough et al. | 292/205 |
| 4,408,914 | 10/1983 | Ciesiel et al. | 400/208 |
| 4,648,637 | 3/1987 | Walter | 292/128 |
| 4,958,867 | 9/1990 | Champagne | 292/259 R |
| 5,114,193 | 5/1992 | Nass | 292/67 |
| 5,114,194 | 5/1992 | Toifl et al. | 292/106 |
| 5,209,533 | 5/1993 | Menard | 292/288 |
| 5,265,921 | 11/1993 | Nikitas et al. | 292/145 |
| 5,358,293 | 10/1994 | Bradley, Jr. et al. | 292/288 |
| 5,388,876 | 2/1995 | Saincome | 292/54 |
| 5,454,610 | 10/1995 | Taylor et al. | 292/339 |
| 5,549,338 | 8/1996 | Wingfield et al. | 292/292 |
| 5,865,480 | 2/1999 | Bain, Jr. et al. | 292/67 |
| 5,931,514 | 8/1999 | Chung | 292/89 |

FOREIGN PATENT DOCUMENTS

| | | | |
|---|---|---|---|
| 2083541 | 3/1982 | United Kingdom | 292/DIG. 65 |

*Primary Examiner*—B. Dayoan
*Assistant Examiner*—Clifford B Vaterlaus
*Attorney, Agent, or Firm*—Sughrue, Mion, Zinn, Macpeak & Seas, PLLC

[57] ABSTRACT

A dishwasher lock includes a first component adapted to be secured to the underside of a counter top directly above the forward upper edge of a dishwasher and a second component slidably and detachably secured to the first component. The second component includes an L-shaped plate adapted to be disposed in overlying engagement with the front of a dishwasher to prevent opening of the dishwasher door when the second component is secured to the first component.

4 Claims, 4 Drawing Sheets

DISHWASHER LOCK

BACKGROUND OF THE INVENTION

The present invention is directed to a dishwasher lock adapted to be secured beneath a counter top which will interact with a dishwasher door to prevent opening of the door by small children.

Numerous accidents have occurred over the years when a small child inadvertently opened a dishwasher door. Frequently, the child is injured, either by the door or by material subsequently retrieved from the dishwasher, such as knives or the like. Numerous types of latches and locking devices have been devised for doors such as cabinet doors and the like. However, this type of latch or locking device requires that a portion of the latch or locking device be secured to the door with another part being secured to an adjacent frame. Securement of a locking element to the dishwasher per se would be unacceptable due to the damage it would cause to the dishwasher.

A locking device for washers and dryers is disclosed in U.S. Pat. No. 4,958,867 which is comprised of a lockable telescopic rod having gripping members at opposite ends thereof for engaging a side of the washer or dryer and a hinged edge of the machine door. However, such a locking device is only suitable for use with a hinged door which only encompasses a small portion of the total area of the front or top of the machine. With a dishwasher, the entire front of the dishwasher pivots about a horizontal axis to the open position and would not accommodate the locking device of the patent.

SUMMARY OF THE INVENTION

The present invention provides a unique dishwasher lock comprised of two parts, one of which is secured to the underside of a counter top and a second part which is slidably connected thereto in overlying relation to the top front portion of a dishwasher door to prevent opening of the same when the two parts of the locking device are disposed in latching engagement with each other. The simple manipulation of a latch release, which would be difficult for a child but easy for an adult, enables the two parts of the dishwasher lock to be disconnected from each other.

The specific nature of the invention, as well as advantages thereof, will clearly appear from the following description and from the accompanying drawings.

BRIEF DESCRIPTION OF THE DRAWING FIGURES

DETAILED DESCRIPTION OF THE INVENTION

Figure 1:
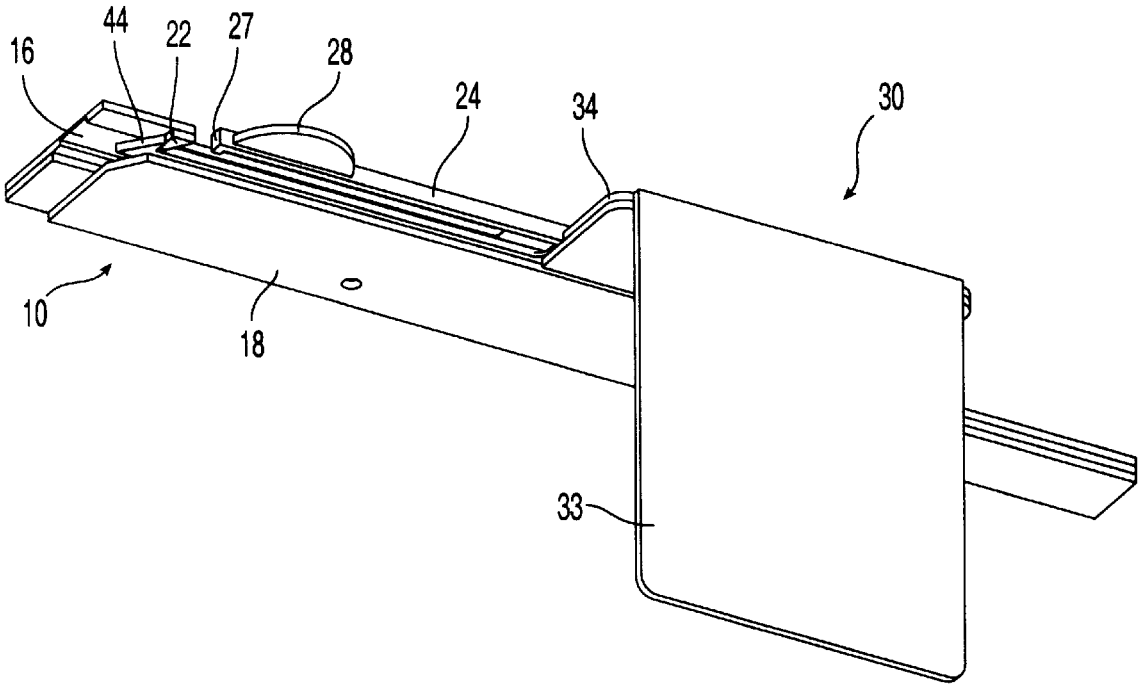
FIG. 1 is a perspective view of the front and bottom of the dishwasher lock in an assembled and locked condition.

The dishwasher lock is comprised of a first component 10 and a second component 30. The first component 10 is comprised of a rectangular plate 12 having a pair of through holes 14 for the reception of screws to secure the plate 12 to the underside of a counter top directly above a dishwasher. The underside of the plate 12 is formed with an elongated downwardly opening groove 16 extending the entire length of the plate 12. A bottom cover plate 18 is secured to the underside of the plate 12 and substantially overlies the entire length of the groove 16. The cover plate 18 is formed with an extension 20 at one end thereof which acts as a lead in guide for the latch of the second component to be described hereinafter. The plate 12 is formed with a recess 21 in the outwardly protruding edge to facilitate operation of the latch. A tooth 22 is formed on the underside of the plate 12 adjacent the left hand edge of the recess 21 which extends into the groove 16. The tooth 22 is provided with a beveled edge facing the recess 21 and a straight edge on the opposite side thereof.

A flexible latch control strip 24 is secured to the forward edge of the plate 12 and overlies the recess 21 for flexing movement into and out of the recess 21. The left hand edge of the flexible latch control strip is provided with an inwardly facing projection 27 and an outwardly facing projection 28 to facilitate operation of the flexible strip 24.

Figure 4:
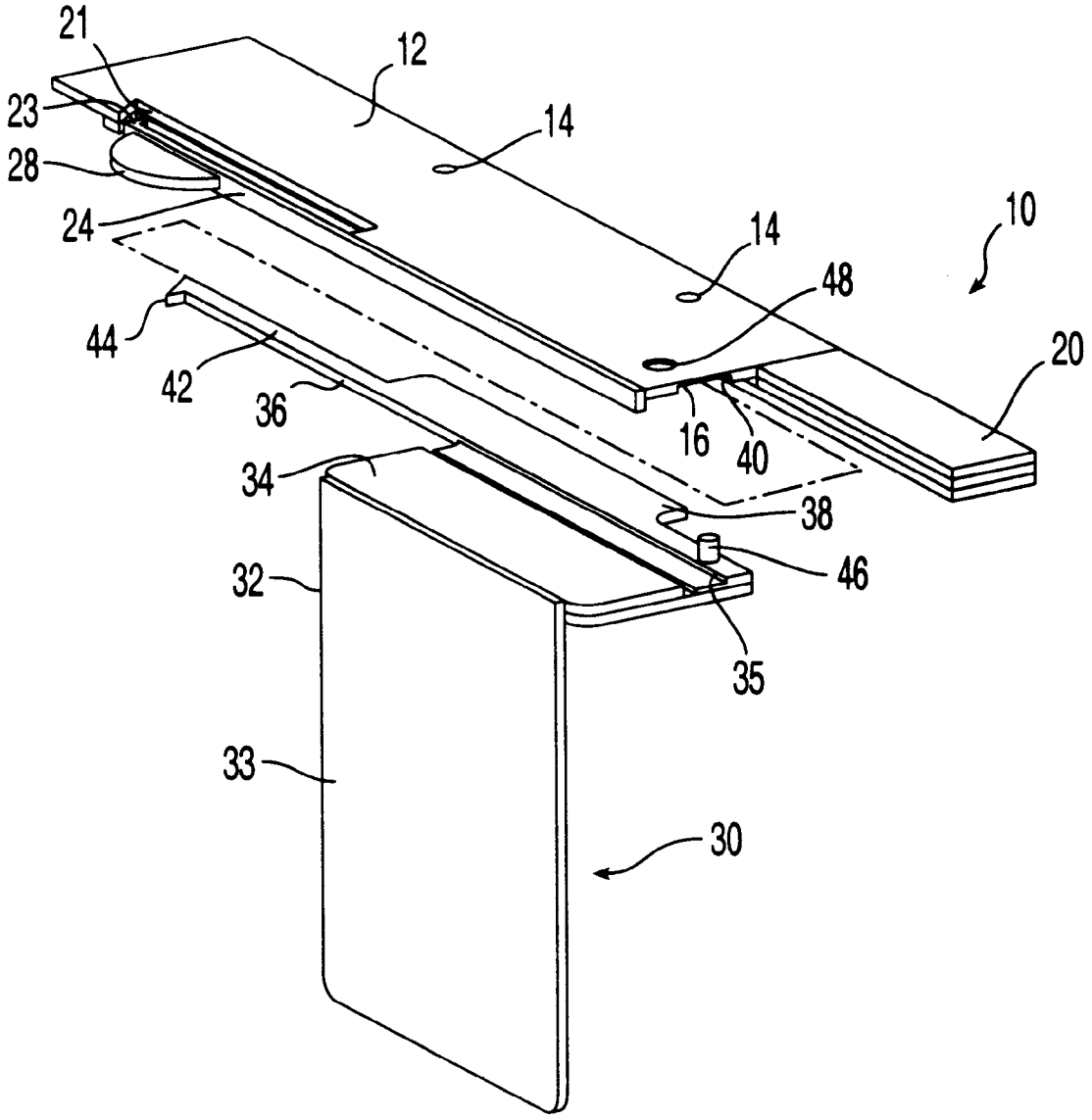
FIG. 4 is an exploded perspective view of the two components of the dishwasher lock showing the direction in which the two components can be assembled and disassembled.

The second component 30 is completely detachable from the first component as shown in FIG. 4. When the second component 30 is completely detached from the first component, the dishwasher door may be opened and closed without any interference whatsoever and the second locking component 30 can be kept on the counter or in a drawer out of sight.

The second component 30 is comprised of an L-shaped plate 32 having a short portion 34 adapted to extend under the plate 12 of the first component and a long portion 33 adapted to extend downwardly in overlapping relation to the front of the dishwasher. The short portion 34 is provided with a latching arm 36 secured to the upper surface of the short portion 34 and extending outwardly a substantial distance past the edge of the short portion 34. A recess 35 extends across the entire width of the short portion 34 adjacent the latching arm 36 which will accommodate the flexible strip 24 upon assembly with the first component 10. The latching arm 36 will be received in the groove 16 on the underside of the plate 12. The latching arm 36 is provided with a wide portion 38 adapted to engage the rear edge of the groove 40. The latching arm 36 is provided with a narrower flexible portion 42 having a beveled tooth 44 protruding outwardly from the end thereof. A latching pin 46 is secured to and extends upwardly from the right hand edge of the latching arm 36 as viewed in FIG. 4 for reception in a hole 48 extending through the plate 12.

Figure 3:
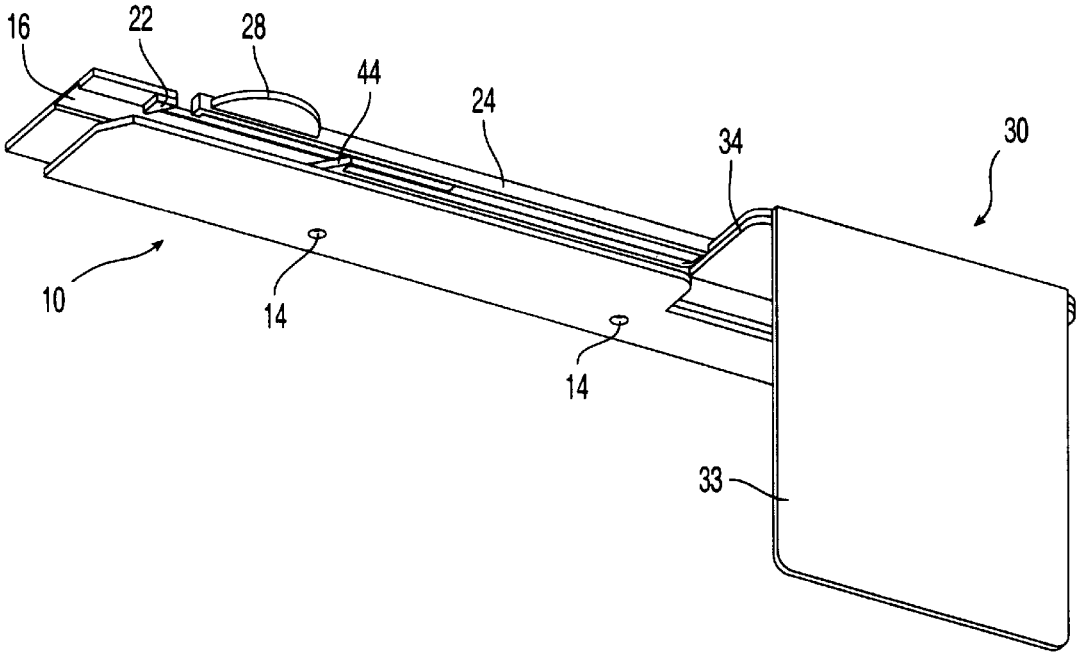
FIG. 3 is a view similar to FIG. 2 with the movable component of the dishwasher lock moved out of locking position but still slidably engaged with the stationary portion of the lock.

In order to secure the second component 30 in latching engagement with the first component 10, the second component 30 is oriented relative to the first component 10 as shown in FIG. 4 and moved in the direction of the dot dash line. The latching arm 36 will enter the groove 16 as shown in FIG. 3 and upon movement of the second component 30 to the left, the beveled tooth 44 will engage the beveled tooth 22 on the underside of the plate 12. Due to the engagement of the beveled surfaces, the flexible portion 42 of the latching arm 36 will flex inwardly, allowing the tooth 44 to move past the tooth 22 into latching engagement therewith as shown in FIG. 1. Since the first and second components are made preferably of plastic material, there is a slight flexibility which allows the latching component to be slightly depressed when the beveled tooth 44 first engages the beveled tooth 22 to allow the locking pin 46 to fit under the plate 12. Upon further movement to the left as viewed in FIG. 3 to move the tooth 44 past the tooth 22, the pin 46 will move upwardly into the hole 48 to provide an additional locking engagement. This is in addition to the locking engagement provided between the teeth 44 and 22. The first and second components are shown in the locked position in FIG. 1. The longer portion 33 of the plate 32 will be disposed in overlying engagement with the front of the dishwasher preventing movement of the dishwasher door to the open position.

Figure 2:
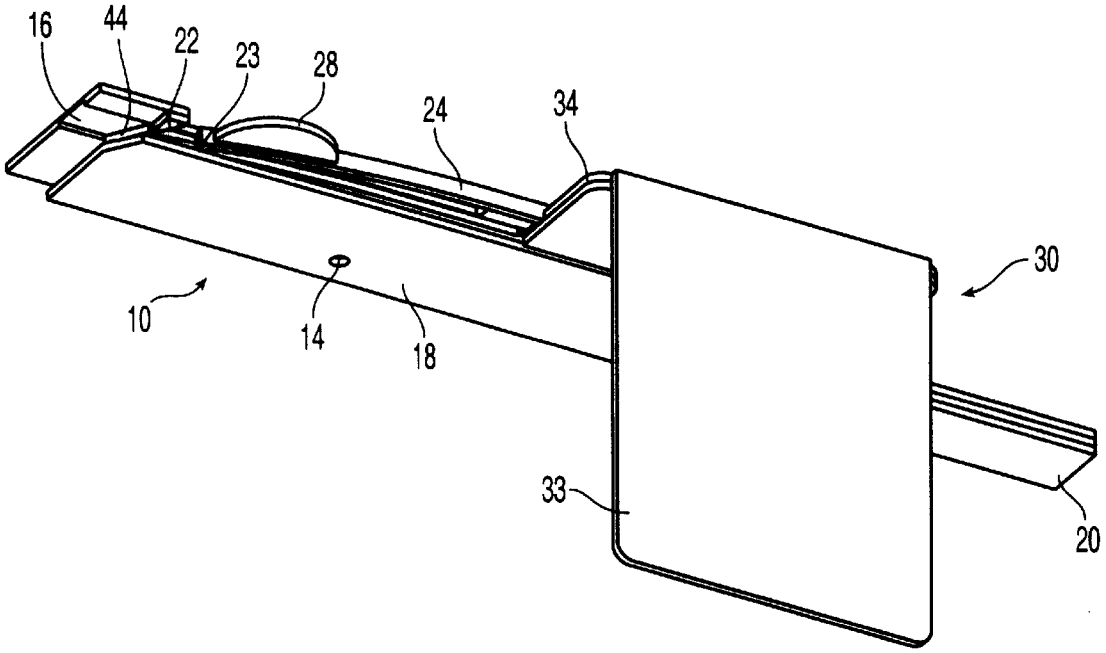
FIG. 2 is a perspective view similar to FIG. 1 showing the latch in a depressed condition which will enable sliding separation of the two components of the lock.

When it is desired to remove the component 30 to allow movement of the dishwasher door, the flexible strip 24 is pushed inwardly by engagement of the projection 28 as shown in FIG. 2. The projection 23 on the strip 24 will engage the flexible portion 42 of the latching arm 36 to move the tooth 44 inwardly relative to the tooth 22 which will allow movement of the tooth 44 past the tooth 22. Simultaneously with the pressing of the projection 28, the right hand side of the second component 30 can be depressed to move the pin 46 out of the hole 48. With the tooth 44 disengaged from the tooth 22 and the pin 46 disengaged from the hole 46, the second component 30 can readily be moved to the right as viewed in the various FIGS to completely remove the second component from engagement with the first component.

While the dishwasher lock as described above can readily be operated by older children, it is sufficiently complex so that younger children cannot open the dishwasher door. Younger children do not have sufficient dexterity or mechanical ability to simultaneously press the projection 28 and depress the right hand side of the second component to unlock the second component from the first component.

While the first and second components are illustrated as being formed from a plurality of elements, many of the components can be molded together as a single element thereby reducing the number of elements required for assembly. Also, the preferred material is plastic but the components may be comprised completely or in part of other materials.

While the preferred embodiment has been described, variations thereto will occur to those skilled in the art within the scope of the present inventive concepts which are delineated by the following claims.

What is claimed is:

1. A dishwasher lock comprising a first component adapted to be secured to the underside of a counter top directly above the top forward edge of a dishwasher and a second component slidably and detachably connected with said first component and adapted to be disposed in overlying relation to a dishwasher door to prevent opening thereof when said first and second components are in a locked condition, wherein said first component is comprised of a flat plate provided with a longitudinal groove and a locking element adjacent one end of the groove and said second component is provided with a flexible latching arm adapted to be slidably received in said groove and having a complementary locking element on one end thereof for detachable engagement with the locking element on the flat plate, said second component having an L-shaped plate secured to said latching arm with a portion of said L-shaped plate adapted to be disposed in overlying engagement with a dishwasher door to prevent opening of the dishwasher door.

2. A dishwasher lock as set forth in claim 1, further comprising a cover plate secured to an under surface of said flat plate, an elongated recess formed in a forward edge of said flat plate, a flexible latch operating strip secured to a forward edge of said flat plate with one end thereof disposed in overlying relation to said recess to permit flexing of said strip into and out of said recess, said locking element being disposed adjacent one end of said recess adjacent an end of said strip, said locking element being comprised of a tooth extending into said groove and having a beveled edge at one end of said recess and a straight edge opposite thereto.

3. A dishwasher lock as set forth in claim 2, wherein said flexible latching arm is provided with a beveled tooth on the end thereof remote from said L-shaped plate whereby upon movement of said latching arm in said groove, said beveled tooth on said flexible latching arm will engage the beveled tooth on said rectangular member to flex the latching arm inwardly to allow movement of the tooth on the latching arm thereon past the tooth on the rectangular member into locking engagement therewith, said flexible strip being adapted to engage the flexible latching arm to press the tooth on the flexible latching arm out of engagement with the tooth on the rectangular member to allow movement of said latching arm out of said groove in said rectangular plate to allow opening of said dishwasher.

4. A dishwasher lock as set forth in claim 1, further comprising additional locking means, said additional locking means being comprised of a pin on said second component adapted to engage a hole in said first component upon movement of said second component into locking engagement with said first component.

* * * * *